US006453135B1

(12) United States Patent
Sameshima et al.

(10) Patent No.: US 6,453,135 B1
(45) Date of Patent: Sep. 17, 2002

(54) IMAGE FORMING APPARATUS HAVING A TRANSFER MATERIAL CARRIER UNIT OR AN INTERMEDIATE TRANSFER BODY UNIT

(75) Inventors: Takao Sameshima, Mishima; Takashi Kimura, Yokohama, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/648,735

(22) Filed: Aug. 28, 2000

(30) Foreign Application Priority Data

Aug. 31, 1999 (JP) ..... 11-245976
Aug. 14, 2000 (JP) ..... 2000-245502

(51) Int. Cl.[7] ..... G03G 15/00; G03G 15/08; G03G 21/16

(52) U.S. Cl. ..... 399/110; 399/111; 399/121; 399/124; 399/302; 399/303

(58) Field of Search ..... 399/302, 303, 399/299, 312, 308, 114, 121, 111, 124, 110

(56) References Cited

U.S. PATENT DOCUMENTS 5,587,769 A * 12/1996 Sawada et al. ..... 399/100 X
5,787,324 A * 7/1998 Iwasaki ..... 399/124 X
5,839,032 A * 11/1998 Yasui et al. ..... 399/124
5,842,095 A * 11/1998 Kitamura ..... 399/299
6,115,568 A * 9/2000 Sameshima ..... 399/110
6,125,251 A * 9/2000 Shiraishi et al. ..... 399/124
6,134,404 A * 10/2000 Iwai et al. ..... 399/110
6,201,943 B1 * 3/2001 Asakura et al. ..... 399/302 X

FOREIGN PATENT DOCUMENTS

JP 3-192274 * 8/1991
JP 2000-112266 * 4/2000

* cited by examiner

*Primary Examiner*—Susan S. Y. Lee
(74) *Attorney, Agent, or Firm*—Fitzpatrick, Cella, Harper & Scinto

(57) ABSTRACT

The present invention relates to an image forming apparatus including an image carrier unit having an image carrier for carrying an image and a transfer material carrier unit having a transfer material carrier for carrying a transfer material, the transfer material carrier unit being capable of assuming a first state when the image on the image carrier is transferred onto a transfer material carried by the transfer material carrier and a second state that the transfer material carrier unit escapes more than the first state. The image carrier unit is detachably attached to an apparatus body through a space formed in the apparatus body after the transfer material carrier unit enters in the second state.

58 Claims, 17 Drawing Sheets

IMAGE FORMING APPARATUS HAVING A TRANSFER MATERIAL CARRIER UNIT OR AN INTERMEDIATE TRANSFER BODY UNIT

BACKGROUND OF THE INVENTION

1. Field of the Invention

This invention relates to an image forming apparatus using an electrophotographic method and, more particularly, to an image forming apparatus such as a printer, facsimile machine, or photocopier.

2. Description of Related Art

As shown in FIG. 16, conventional color image forming apparatuses 100 using an electrophotographic method frequently use an inline method in which multicolor image carriers 102 are arranged in a row. In FIG. 16, the respective image carriers 102 are formed with electrophotostatic latent images by an exposing means 103, and carry toner images visualized by multicolor toners by means of developing means. A transfer material sent out of a feeding section 104 by a feeding roller 105 receives by transfer the respective color toner images from the image carriers 102 by an electrostatically attracting transfer belt 106, and is delivered to a delivery means 108 provided outside the machine body and stacked there after images are fixed to the transfer material with the application of heat and pressure from a fixing means 107.

Color image forming apparatuses of the inline type used currently, in major part, use LEDs as exposing means as shown in FIG. 17, and such exposing means 103 are structured to be open and closed in a united body with a top lid. The respective exposing means 103 are placed at predetermined positions upon closing the top lid and are immobilized by being pushed by utilizing a compression spring.

However, the image forming apparatus as shown in FIG. 17 is required to move the exposing means together with the top lid when a process cartridge 101 is maintained or replaced or paper jamming recovery is made. Thus, as opening and closing operations of the top lid are repeated, positions of the exposing means correlative to the image carriers are more or less shifted, thereby deviating the exposure positions. This deviation of the exposure positions renders formed images shifted or inclined, and when color images are formed, image defects may occur due to a color shift or like.

To avoid the above problems, a possible structure is that the process cartridge can be removed from an upper portion of the apparatus without moving the exposing means, but this structure is required to dispose the exposing means and the process cartridge in a non-overlapping manner in a horizontal direction in FIG. 17, so that the structure may raise a problem that apparatus may be made larger.

SUMMARY OF THE INVENTION

It is an object of the invention to provide an image forming apparatus capable of maintaining and replacing the image carrier units and improving the workability of paper-jamming recovery.

Another object of the invention may become apparent when the following detailed description is read.

DETAILED DESCRIPTION OF THE PREFERRED EMBODIMENTS

Figure 1:
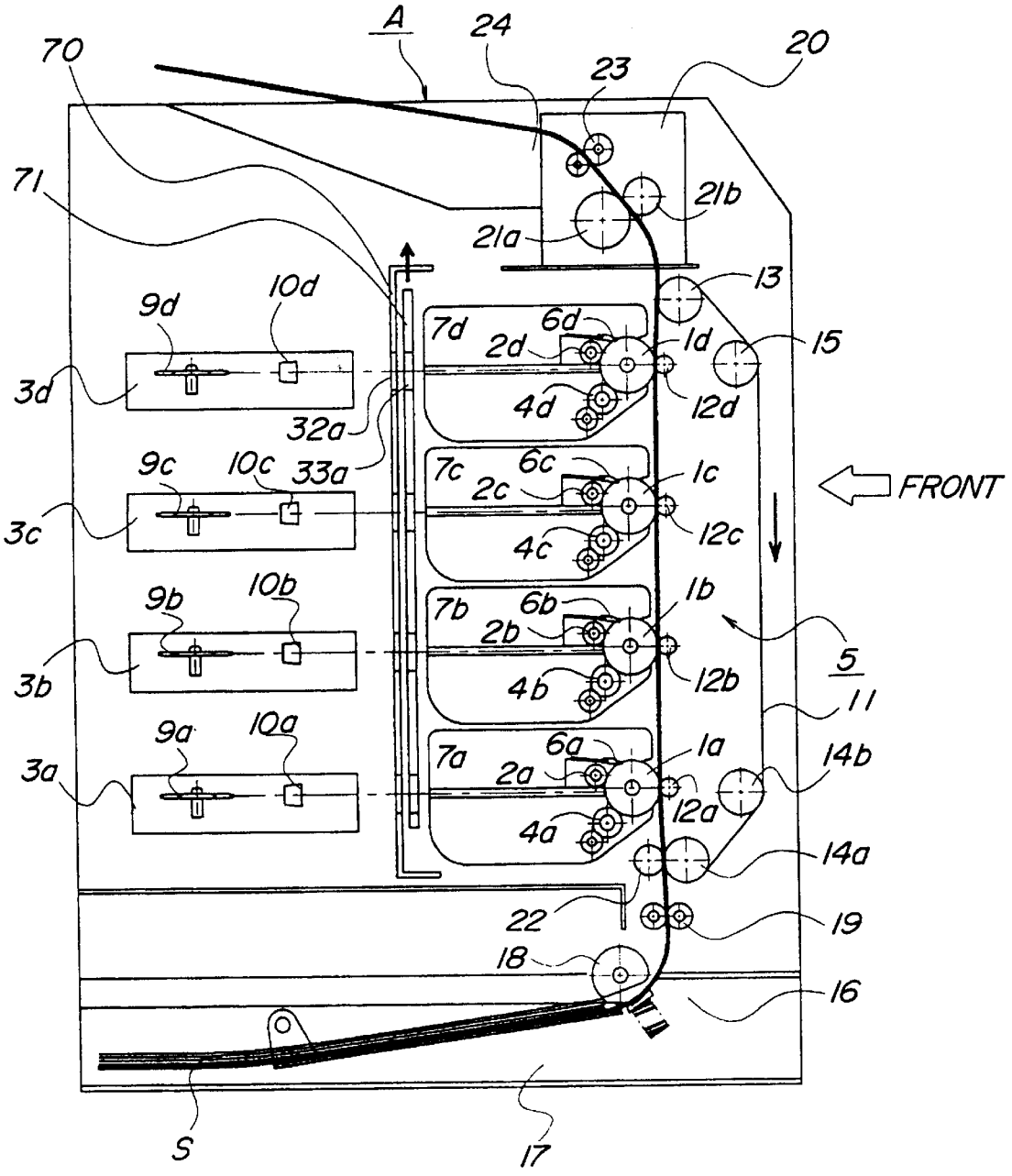
FIG. 1 is an entire view showing an image forming apparatus according to a first embodiment.

Referring to the drawings, embodiments according to the invention are described below.

First Embodiment

In this embodiment, as an image forming apparatus, a full color laser beam printer A is described as an example.

A full color laser beam printer A as shown in FIG. 1 has four image carriers 1*a* to 1*d* arranged in a vertical direction. Each of the image carriers 1 is rotatively driven in a counterclockwise direction in FIG. 1 by a drive means, not shown. Provided around the image carrier 1 in the order of the rotational direction are charging means 2*a* to 2*d* for uniformly charging surfaces of the image carriers 1, scanner units 3*a* to 3*d* serving as exposing means for forming electrostatic latent images on the image carrier 1 by irradiating the image carrier with a laser beam based on image information, developing means 4*a* to 4*d* for developing toner images by adhering negatively charged toner to the electrostatic latent images, a conveyance apparatus 5 for conveying a transfer material to transfer the toner images on the image carrier 1 to a sheet S as a transfer material, and cleaning means 6*a* to 6*d* for removing post-transfer remaining toner remaining on the surface of the image carrier after transfer. The image carriers 1, the charging means 2, the developing means 4, and the cleaning means 6 are made in a united body and into a cartridge, thereby forming a process cartridge 7 as an image carrier unit.

The image carrier 1 is structured of an aluminum cylinder having, e.g., a diameter of 30 mm and an outer peripheral surface coated with an organic photo-conductive layer (OPC photosensitive material). The image carrier 1 is supported as freely rotatable by a support member at each end of the carrier, and the drive force from a drive motor is transmitted to one end, thereby rotatively driving the carrier in the counterclockwise direction.

As such a charging means 2, used is a contact charging type. The charging means 2 is a conductive roller formed in a roller shape, and the roller is made in contact with the surface of the image carrier 1 and is biased to a charging bias voltage (e.g., negative, in this embodiment), thereby charging the surface of the image carrier 12 uniformly.

The scanner unit 3 is disposed approximately at the rear of the image carrier 1. Image lights corresponding to image signals emitted out of laser diodes, not shown, irradiate polygonal mirrors 9*a* to 9*d* as scanning means, which are rotated at a high rate by a scanner motor. The image light reflected at the polygonal mirror forms electrostatic latent images by selectively exposing to the light the surface of image carriers 1 which are charged by focusing lenses 10*a* to 10*d*. Each of the developing means 4*a* to 4*d* is constituted of a developer containing each color among yellow, magenta, cyan, and black.

The conveyance apparatus 5 as a transfer material carrier unit is structured to have, as a united body, an electrostatically attracting conveyance belt (hereinafter referred to as conveyance belt 11) serving as a transfer material carrier for conveying the sheet S upon attracting the sheet so that the belt is in contact with all the image carriers 1*a* to 1*d* as opposing to the carriers. The conveyance belt 11 is made of a film shaped member having a peripheral length of about 700 mm and thickness of about 150 $\mu$m and has a volume eigen-resistance of $10^{11}$ to $10^{14}$ $\Omega\cdot$m. This conveyance belt 11 is supported in a vertical direction by four axes of a drive roller 13, driven rollers 14*a*, 14*b*, a tension roller 15, attracts the sheet S electrostatically on the outer peripheral surface on a left side, and moves circularly in rendering the sheet S in contact with the image carriers 1.

Transfer rollers 12*a* to 12*d* as transfer means are disposed at positions respectively corresponding to the image carriers 1*a* to 1*d* inside the conveyance belt 11. Charges having positive polarity out of those transfer rollers 12 are applied to the sheet S via the conveyance belt 11, and toner images having negative polarity on the image carrier 1 are transferred on the sheet S in contact with the image carrier 1.

A feeding section 16 for feeding the sheet S is disposed at a lower portion of the apparatus body. Plural sheets are contained in feeding cassettes 17 of the feeding section 16, and the feeding section 16 feeds separately the sheets S, sheet by sheet, in the feeding cassettes 17 where feeding rollers 18, in a half moon shape, drive rotatively during image formation. The front end of the fed sheet S stops temporarily when contacting a register roller 19, thereby correcting oblique feeding while forming a loop, and the sheet S is fed to the conveyance belt 11 in synchrony with the image writing start position of the image carrier 1.

A fixing section 20 is for fixing toner images of multiple colors transferred on the sheet S and is constituted of a rotatable heating roller 21*a* and a pressing roller 21*b* for application of heat and pressure to the sheet S in pressed contact with the heating roller 21. That is, the sheet S with the transferred toner image on the image carrier 1 is conveyed by the heating roller 21*a* and the pressing roller 21*b* when passing the fixing section 20, and the toner image is fixed to a surface of the sheet S by application of heat and pressure.

[Image Forming Operation]

To form images, process cartridges 7*a* to 7*d* are sequentially driven in meeting the recording timings, and the image carriers 1*a* to 1*d* rotatively drive in the counterclockwise direction according to the drive. Then, the scanner units 3 corresponding to the process cartridges 7 are sequentially driven. With this drive, the charging means 2 provides uniform charges to the surface of the image carrier 1, and the scanner unit 3 makes exposure around the image carrier 1 according to the image signals, thereby forming an electrostatic latent image on the peripheral surface of the image carrier 1, and thereby forming the toner images by transferring toner in the developing means 4 to a lower potential portion (dark portion) of the electrostatic latent image.

The register roller pair 19 is rotatively driven in synchrony with the image carrier 1, and the sheet is so conveyed that the front end of the toner image on the peripheral surface of the image carrier 1 on the most unstream side coincides to the recording starting position of the sheet S. The sheet S is in pressurized contact with the conveyance belt 11 by being pushed by the electrostatic attracting roller 22. Electric charges are induced at the sheet S as a dielectric body and a dielectric layer of the conveyance belt 11 by application of voltage between the conveyance belt 11 and the electrostatic attracting roller 22 thereby attracting the sheet electrostatically on the outer peripheral surface of the conveyance belt 11. Thus, the sheet S is attracted stably by the conveyance belt 11 and conveyed to the transfer portion on the most downstream side. While conveyed in such a manner the respective color toner images on the image carriers 1 are sequentially transferred to the sheet S by an electric field formed between the respective image carrier 1 and the transfer roller 12.

The sheet S, with four color (yellow, magenta, cyan, black) transferred toner images, is separated according to the curvature from the conveyance belt 11 by the curvature of the drive roller 13, and is conveyed to the fixing section 20. The sheet S, after the toner images are fixed at the fixing section 20, is delivered out of the apparatus body in a state that the image surface faces down from the delivery portion 24 by the delivery roller pair 23.

Figure 2:
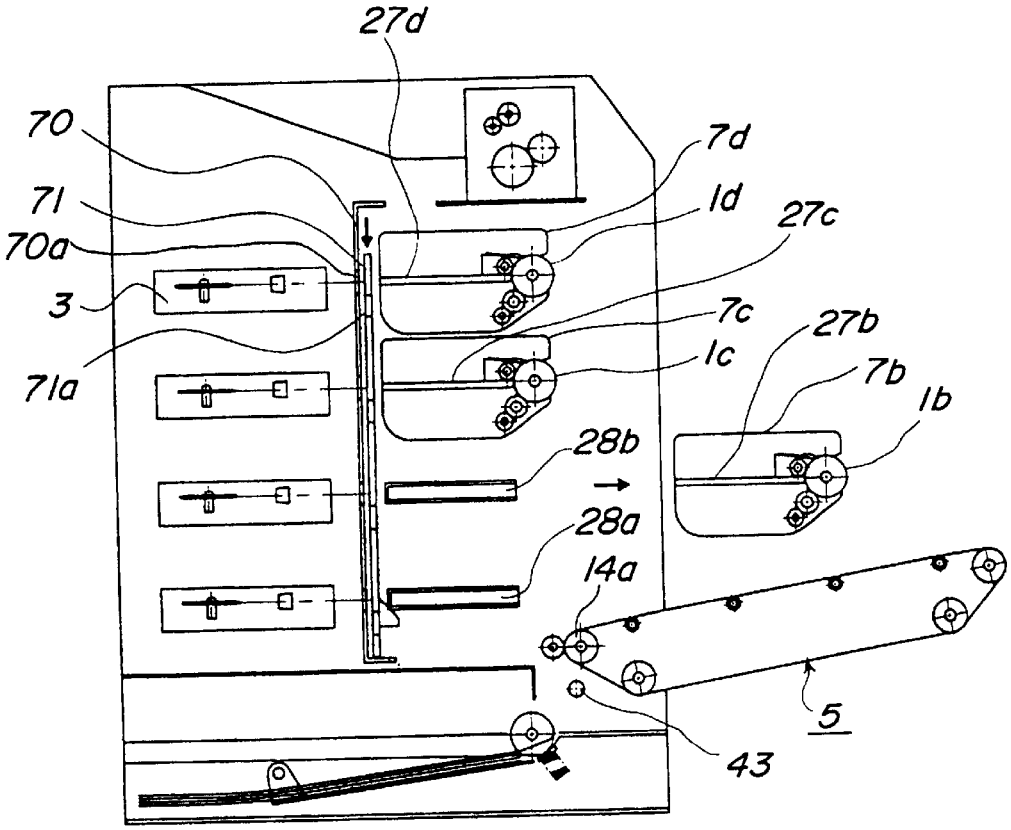
FIG. 2 is an entire view of an image forming apparatus, showing an open state of a transfer means.
Figure 3:
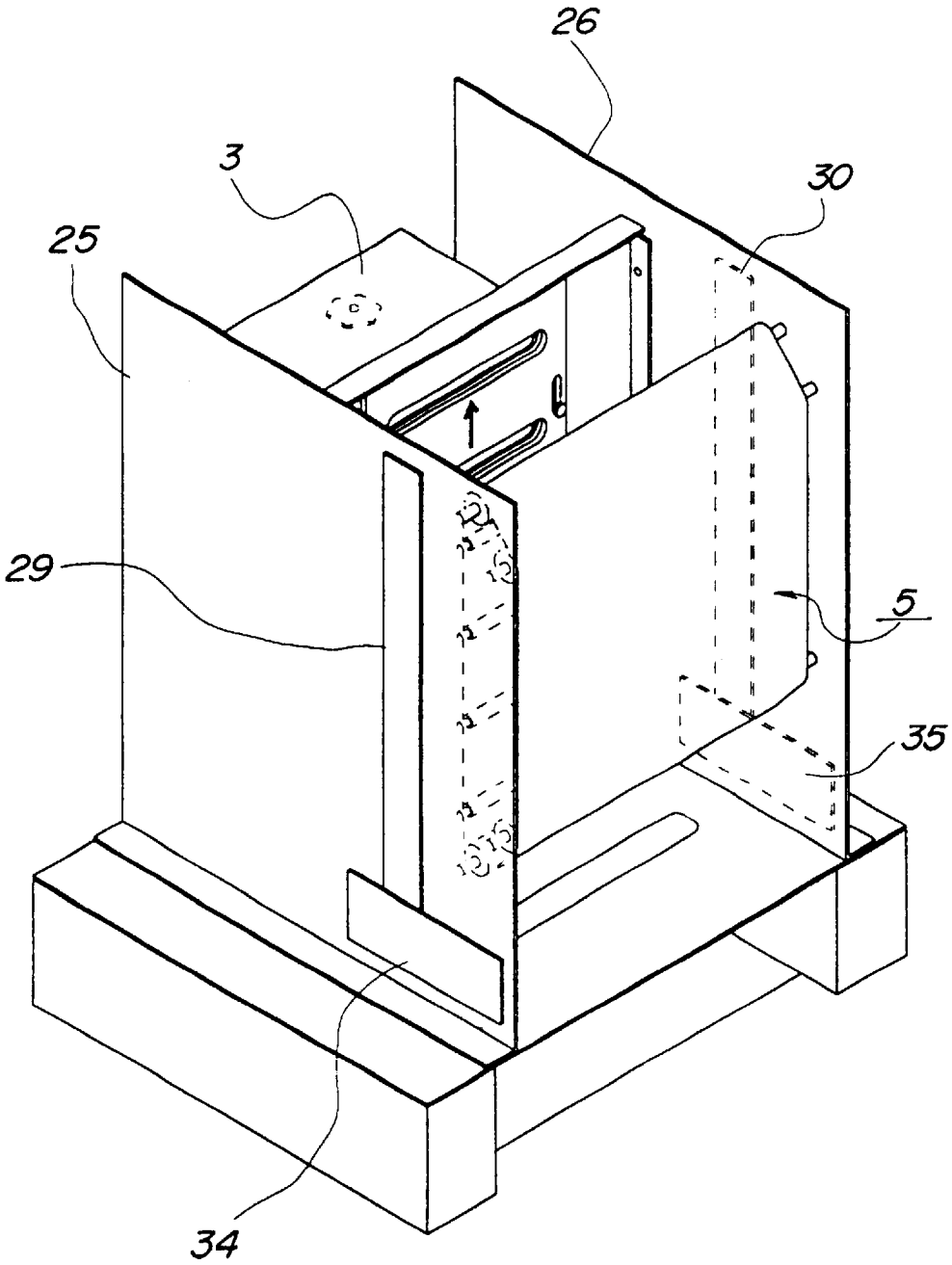
FIG. 3 is a schematic perspective view showing an image forming apparatus.

Next, a joint movement mechanism operational in association with swinging, opening and closing of the conveyance apparatus 5, a feature of the invention, will be described. As shown in FIG. 2, the conveyance apparatus 5 is structured to be rotatable about a rotary shaft as a center, and upon disengagement of a lock lever, not shown, the apparatus can swing and be open and closed toward a front side of the apparatus body. That is, the conveyance apparatus 5 can take two states: a state that the toner image on the image carrier is transferred to the transfer material (state that the image carrier and the conveyance belt are in contact with each other), and a state that the image carrier is kept further away than the above state (state that the conveyance belt is separated from the image carrier). Thus, while the conveyance apparatus 5 is set in the closed state, the sheet S can be conveyed as facing up in the approximately vertical direction. After the conveyance apparatus 5 is swung, or moved pivotally, the process cartridges 7*a* to 7*d* are detachably attached to the front aside of the apparatus body in a direction substantially perpendicular to the rotary shaft of the image carrier in utilizing a space formed within the apparatus body, so that the respective process cartridges 7 can be replaced and the respective color toners can be filled. Furthermore, when paper jamming occurs, the jammed paper on the conveyance belt 11 can be removed easily.

Thus, the respective process cartridges and the conveyance apparatus are structured to be detachably attachable to the front aside of the apparatus body in about the same direction. The apparatus body can be prevented from lowering the rigidity of the apparatus body because the apparatus body can be structured without, in two side plates placed at the front, rear, right and left sides as forming the apparatus body, any large cutouts such that each of the process cartridge and the conveyance apparatus can pass through.

Because the process cartridge and the conveyance apparatus are detachable from the apparatus body in a direction substantially perpendicular to the respective rotary shafts, the side plates directly or indirectly supporting the rotary shafts can be prevented from lowering the rigidity of the side plates, so that the invented mechanism can prevent rotational deviations from occurring in the process cartridge and the conveyance apparatus.

Figure 4:
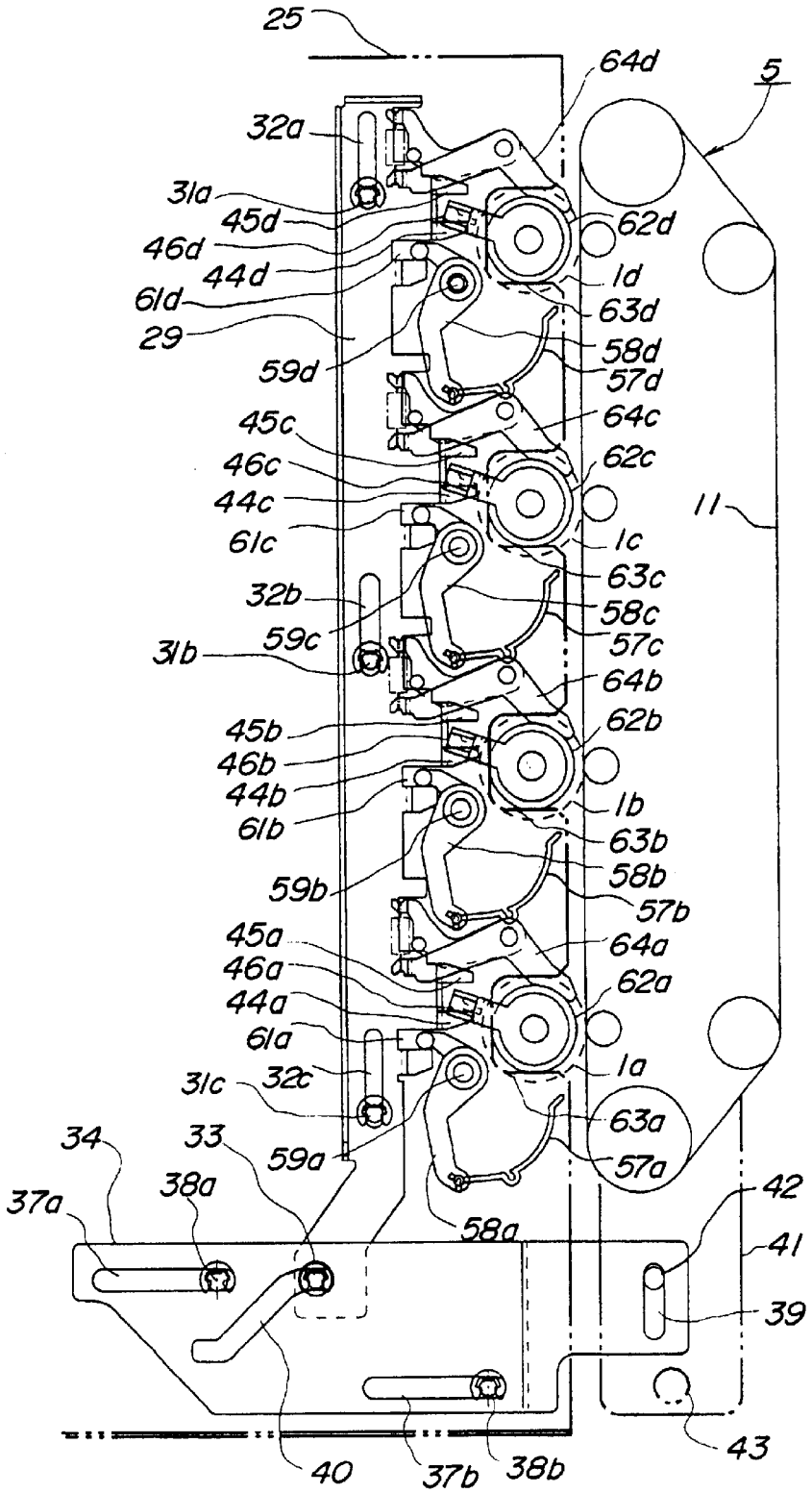
FIG. 4 is an illustration describing a joint movement plate in a state that the transfer means is closed.
Figure 5:
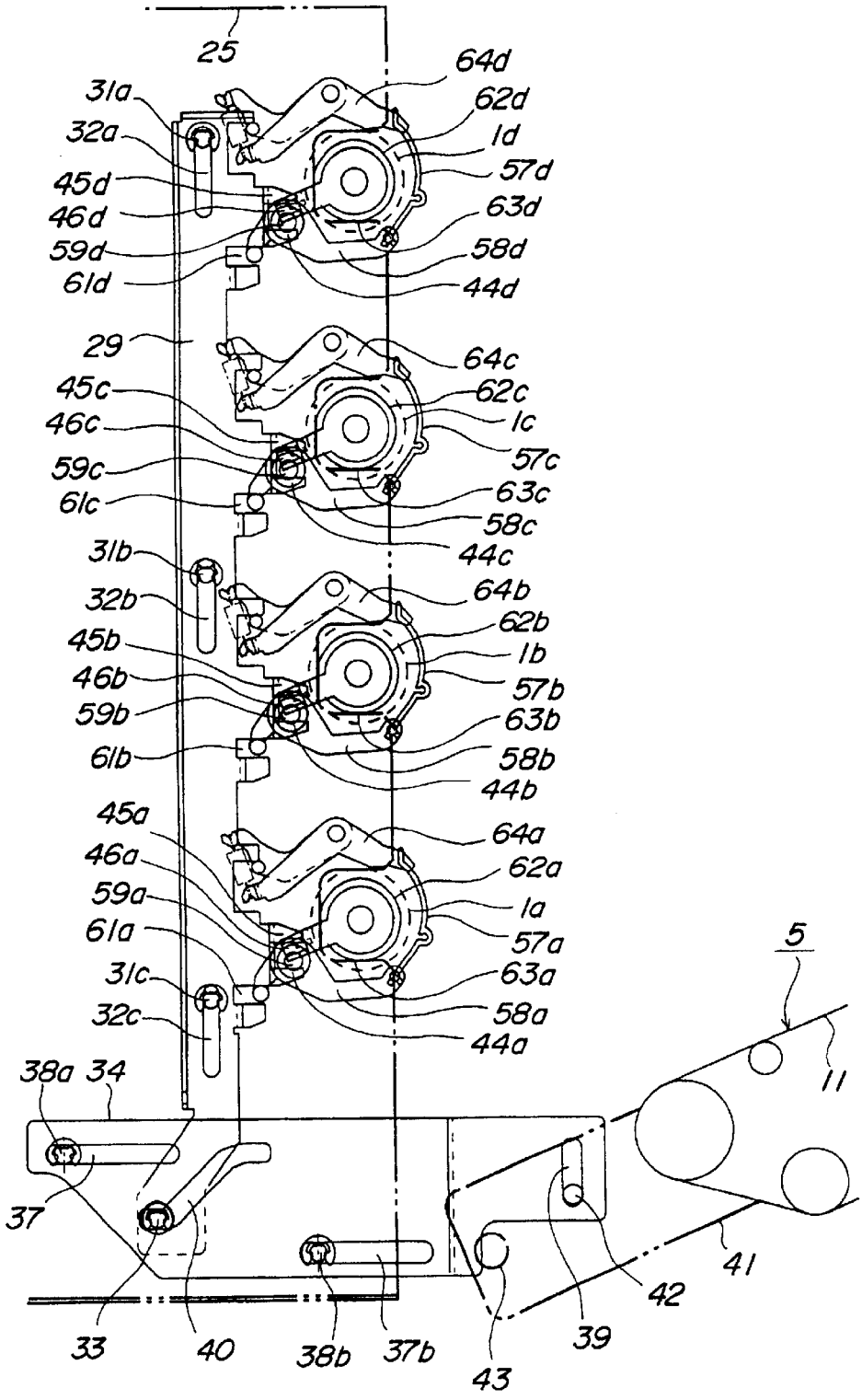
FIG. 5 is an illustration describing the joint movement plate in a state that the transfer means is open.

FIG. 4 and FIG. 5 are detailed views showing a joint state of a joint movement plate 29 and a conveyance apparatus 5. FIG. 4 shows a closed state of the conveyance apparatus 5; FIG. 5 shows an open state of the conveyance apparatus 5. In FIG. 4, the joint movement plate 29 is urged by an E ring to secured shafts 31*a* to 31*c* formed at a left side plate 25 and mounted slidably up and down in a range of long holes 32*a* to 32*c* formed in the joint movement plate 29. The secured shaft 33 formed at the joint movement plate 29 is connected with a cam sliding groove 40 formed at the lateral sliding plate 34.

Lateral sliding grooves 37*a*, 37*b* formed at the lateral sliding plate 34 are connected to secured shafts 38*a*, 38*b* formed at the left side plate 25, and the lateral sliding plate 34 is formed slidably in a lateral direction in a width of the lateral sliding grooves 37*a*, 37*b*. A vertical sliding groove 39 formed at the lateral sliding plate 34 is connected to a secured shaft 42 formed at a frame 41 of the conveyance apparatus 5.

Accordingly, when the conveyance apparatus 5 is made open by rotating the conveyance apparatus 5 around a rotary shaft (swinging shaft) 43 as a center from a state in FIG. 4 to a state in FIG. 5, the secured shaft 42 formed at the frame 41 pushes the vertical sliding groove 39 of the lateral sliding plate 34, thereby moving the lateral sliding plate 34 toward the outside of the apparatus from the state as shown in FIG. 4 to the state as shown in FIG. 5. The joint movement plate 29, according to this motion, moves to a lower portion as shown in FIG. 5 where the secured shaft 33 is pushed by a cam slider 40 of the lateral sliding plate 34.

The joint movement plate 29 is herein structured to connect an engagement and disengagement mechanism for coupling and for transmitting a rotational drive force to the respective image carriers 1 of the process cartridges 7 in connecting to the rotary shaft of each image carrier 1, an opening and closing mechanism of a protection cover for covering the respective image carriers 1 to prevent users from touching the surface of the photosensitive body, a securing mechanism for securing with pressure and releasing the respective process cartridges 7 at predetermined positions of the apparatus body, and an opening and closing mechanism of a light path shielding shutter for shielding the light path from the exposing means to the image carrier, and each of which jointly moves according to opening and closing of the conveyance apparatus 5. Hereinafter, each mechanism is describe.

[Coupling for connecting image carrier drive]

As shown in FIG. 4, coupling engagement and disengagement levers 46*a* to 46*d*, serving as connection disengaging means for drive transmission to the image carrier, are formed on the rotary shafts of the image carriers 1. Coupling engagement brackets 44*a* to 44*d* and coupling disengagement brackets 46*a* to 46*d* are provided at the joint movement plate 29. As described above, where the conveyance apparatus 5 is in the closed state, the joint movement plate 29 is located upwardly, and the coupling engagement brackets 44*a* to 44*d* render the coupling engagement and disengagement levers 46*a* to 46*d* are moved pivotally upward.

Figure 6:
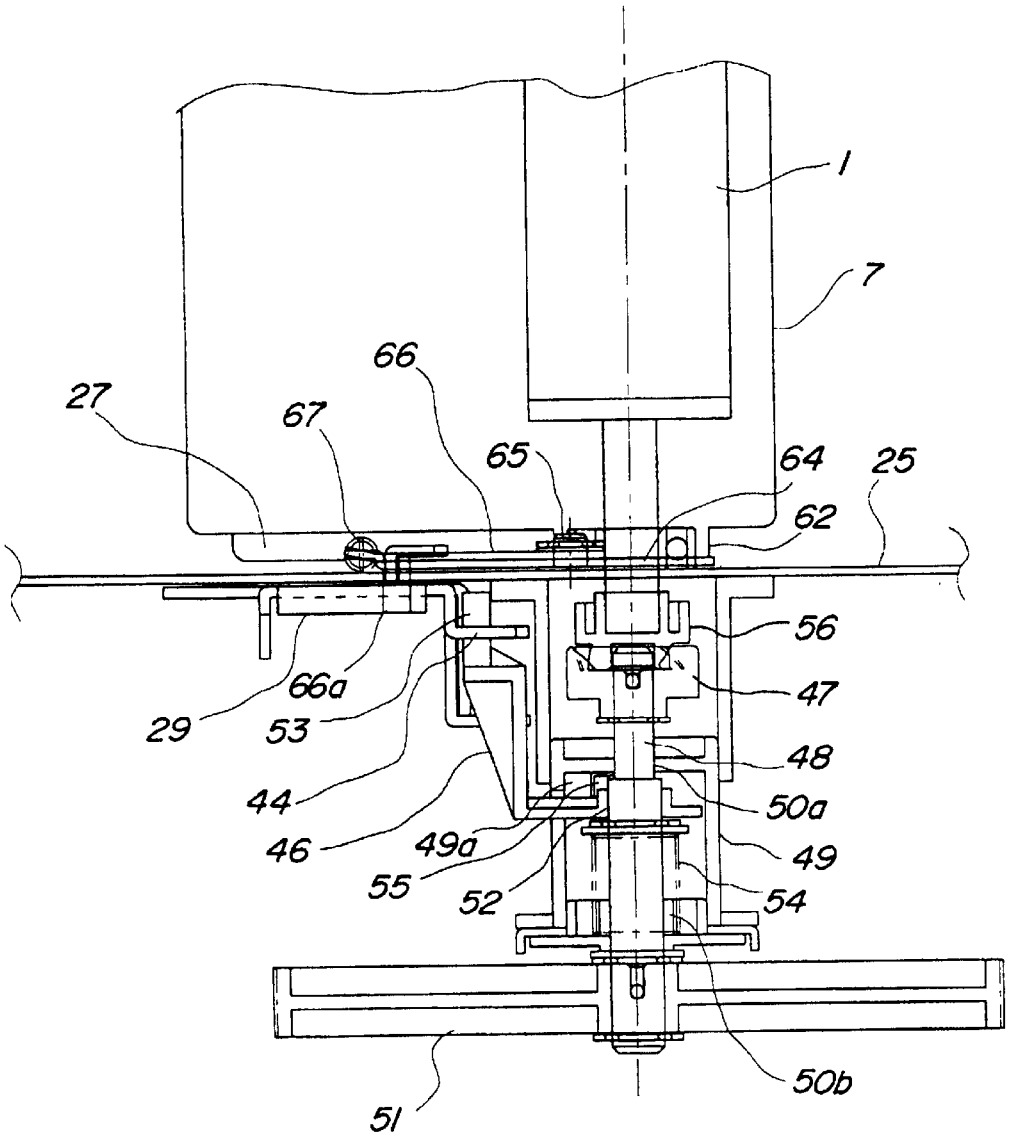
FIG. 6 is a plain view describing a drive joint in a state that the transfer means is closed.

FIG. 6 is a view showing the coupling mechanism in the engagement state when viewed from the top. As shown in FIG. 6, a coupling 47 on the drive side is secured to a coupling shaft 48, and the coupling shaft 48 is supported slidably in the up and down directions in FIG. 6 by bearings 50*a*,50*b* of a cylinder 49. A gear 51 is secured to the other end of the coupling shaft 48 for transmission of a rotary drive force from a drive source, not shown.

The coupling engagement and disengagement lever 46 rotates over the coupling shaft 48 at the bearing 52, fits movably in a thrust direction, and connects via a lever portion 53 with the coupling engagement bracket 44 of the joint movement plate 29. The coupling shaft 48 is urged toward the side of the image carrier 1 (upper direction in FIG. 6) by a compression spring 54. A projection 55 is formed on an outer peripheral surface of the bearing of the coupling engagement and disengagement lever 46, and a projection 49*a* is formed on the cylinder 49, so that both of the projections are engaged with each other where not hitting to each other.

Figure 7:
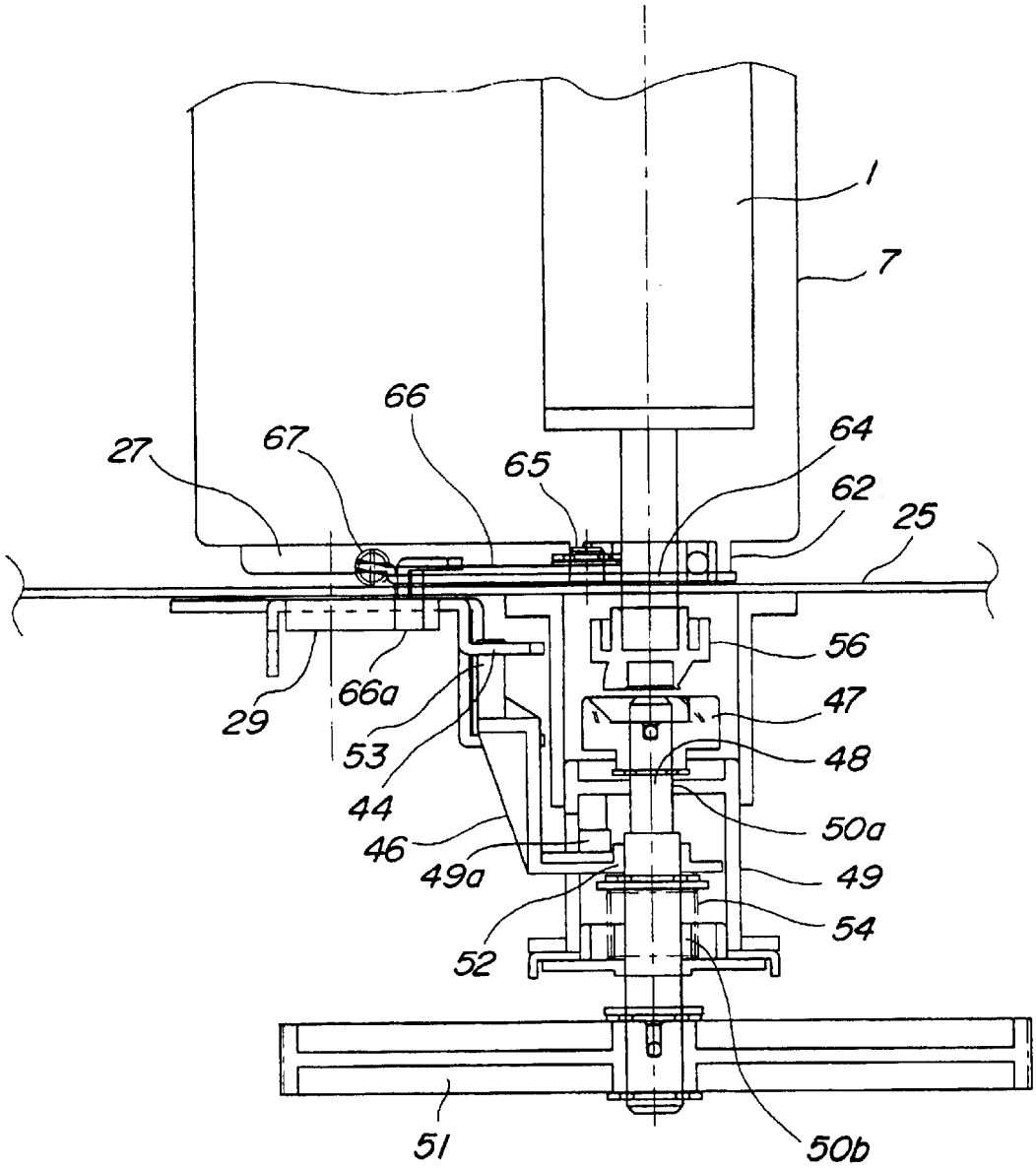
FIG. 7 is a plain view describing the drive joint in a state that the transfer means is open.
Figure 8A:
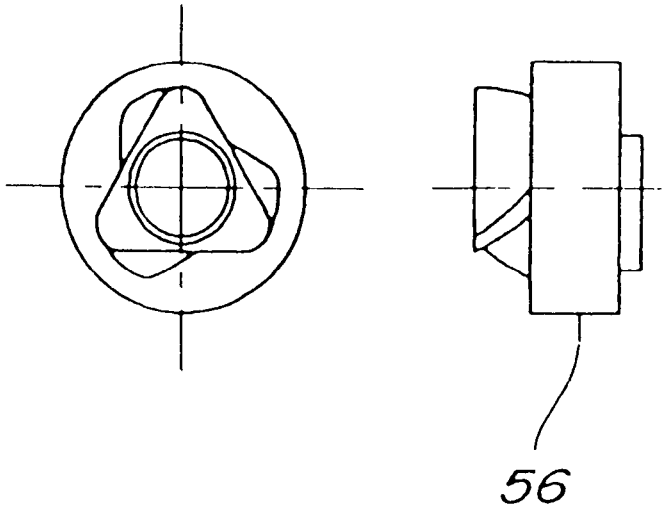
FIG. 8 is a view describing a coupling of the drive joint.
Figure 8B:
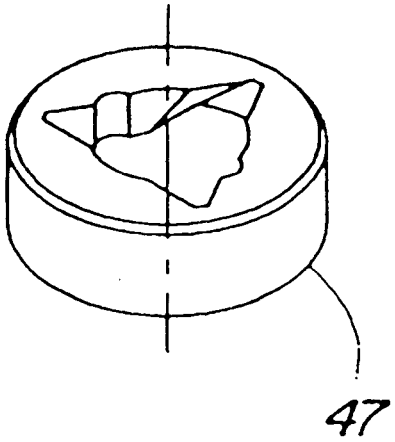

A driven coupling 56 is secured to an end face of the rotary shaft of the image carrier 1 of the process cartridge 7 and engages with a drive coupling 57 to transmit the rotary drive force. The driven coupling 56 and the drive coupling 57 are couplings in a triangle spiral shape as shown in FIG. 8, and the compression spring 54 pushes the couplings where the drive coupling 47 rotates in a predetermined direction, so that the couplings always engages with each other.

Where the conveyance apparatus 5 is made to be shifted from the closed state in FIG. 4 to the open state as shown in FIG. 5, the joint movement plate 29 moves downward via the lateral sliding plate 34 as described above. The coupling disengagement bracket 45 at that time pushes the lever portion 53 of the coupling engagement disengagement lever 46 as shown in FIG. 7 to rotate about the coupling shaft 48 as a center. The projection 55 of the coupling engagement disengagement lever 46 then rides over the projection 49*a* of the cylinder 49 in opposing the force of the compression spring 54 and moves downward in FIG. 7. According to this movement, the coupling shaft 48, and the drive coupling 47 come to move, thereby disengaging the mesh of the couplings.

Where the conveyance apparatus 5 is made to be shifted from the open state in FIG. 5 to the closed state in FIG. 4, the reverse operations are made to engage the drive coupling 47 and the driven coupling 56 with each other. In regard with coupling means as an engagement disengagement means for transmitting a drive force to a development sleeve serving as a developer carrier for conveying a developing section in carrying developers in the developing means 4, and coupling means as an engagement and disengagement means for transmitting a drive force to conveying means for conveying waste toner collected by the cleaning means 6 (cleaning blade), the similar structure becomes operational.

[Image Carrier Protection Cover Opening and Closing Mechanism]

As shown in FIG. 4, protection covers 57*a* to 57*d* serving as moving members are formed at the image carriers 1. This protection cover 57 avoids the image carrier 1 to be exposed while the conveyance apparatus 5 is disengaged and prevents dusts from attaching and image defects from occurring due to the surface receiving damages.

Figure 9:
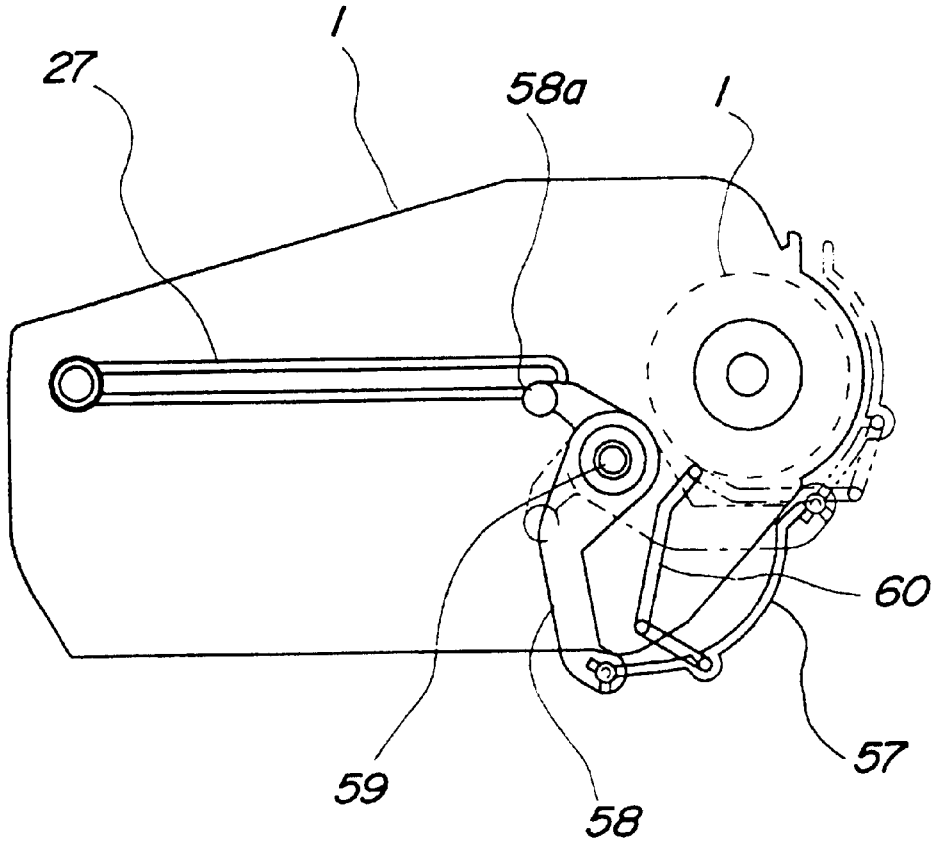
FIG. 9 is a side view of a process cartridge.

As shown in FIG. 9, opening and closing levers 58*a* to 58*d* serving as opening and closing drive means of the protection cover 57 are supported by rotary shafts 59*a* to 59*d*, respectively and constitute link mechanisms with opening and closing guide pins 60. Each of the opening and closing levers 58*a* to 58*d* has one end connected to a protection cover 57 and a pin portion 58*a* as the other end. That is, by moving up and down the pin portion 58*a*, the protection cover 57 can be made to open and close with respect to the image carrier 1 as shown with solid lines and dotted lines, respectively. The pin portions 58*a* are inserted in the opening and closing lever grooves 61*a* to 61*d*, respectively, of the joint movement plate 29 as shown in FIG. 4.

As shown in FIG. 4, where the conveyance apparatus 5 is in a closed state, the joint movement plate 29 is located upward as described above. At that time, the pin portion 58*a* is lifted up by the opening and closing lever groove 61, and the protection cover 57 is located downward to expose the image carrier 1.

Then, as shown in FIG. 5, where the conveyance apparatus 5 is opened, and where the joint movement plate 29 is moved downward, the opening and closing lever groove 61 moves the pin portion 58*s* down, and by the link mechanism, the protection cover 57 moves to a position covering the image carrier surface. Where the conveyance apparatus 5 is closed, the opening and closing lever groove 61 pushes up the pin portion 58*a*, thereby causing the protection cover 57 to escape from the image carrier surface. With the apparatus thus structured, when the conveyance apparatus 5 is open to treat paper jamming, the image carrier surface can be always protected, and the apparatus can prevent dusts from attaching and users from mistakenly touching and damaging the surface.

[Process Cartridge Securing Mechanism]

Figure 10:
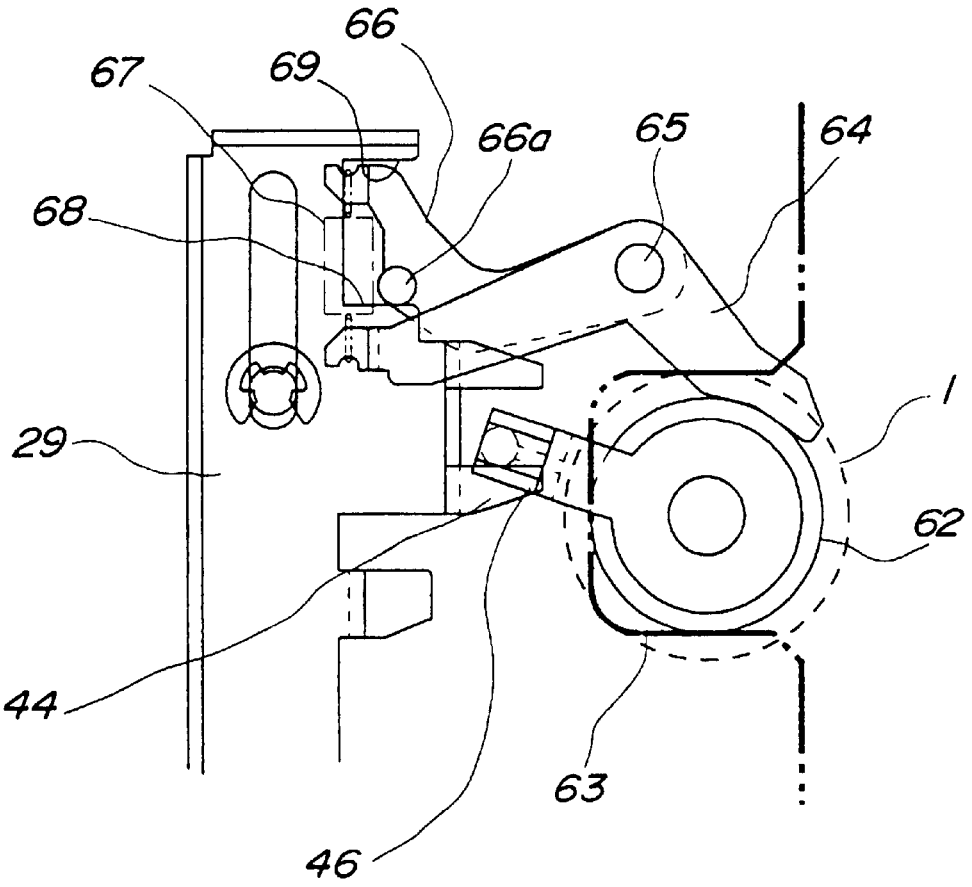
FIG. 10 is an illustration showing the state that the process cartridge is secured.
Figure 11:
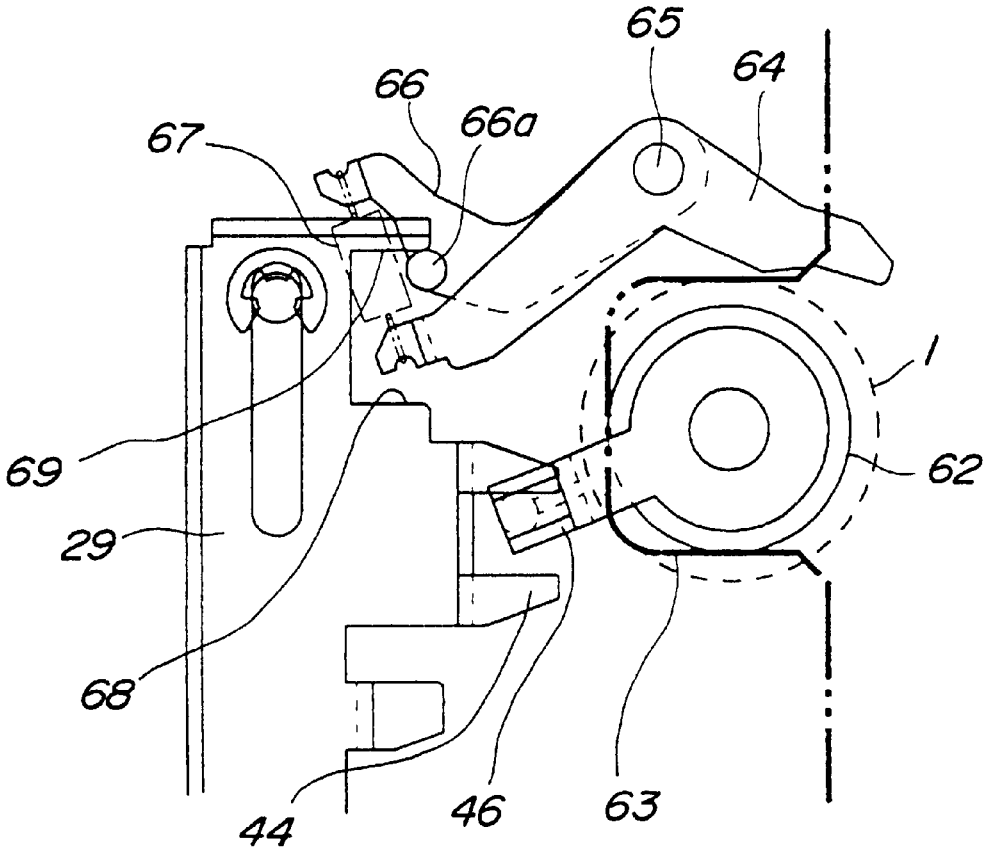
FIG. 11 is an illustration the state that the secured process cartridge is released.

FIG. 10 is a detailed view showing the process cartridge in a state that the process cartridge is secured to the apparatus body; FIG. 11 is a detailed view showing the process cartridge in a state that the secured process cartridge is disengaged from the apparatus body. In this embodiment, cartridge securing levers 64*a* to 64*d* are provided as securing means for engaging and disengaging the image carrier to and from the apparatus body, and by closing the conveyance apparatus 5, the bearings 62*a* to 62*d* are pushed against the cutouts 63*a* to 63*d*, thereby securing the image carriers 1.

The process cartridge 7 is structured, as described above, as to be detachably attached to the apparatus body. When the process cartridge 7 is attached, guide ribs arranged on both sides of the process cartridge 7 are inserted into cartridge guides 28 provided on right and left side plates and guided through the guides. The bearing 62 of the image carrier 1 then hits, as shown in FIG. 10, the cutout 63 for positioning formed in the right side plate 26 and the left side plate 25. Meanwhile, the cartridge securing lever 64 is arranged at the apparatus body and supported via a rotary shaft 65 to the right and left side plates 25, 26. A securing assisting plate 66 is attached to the rotary shaft 65, thereby linking between the end of the cartridge securing lever 64 and a pulling spring 67.

As shown in FIG. 4 and FIG. 10, in the state that the conveyance apparatus 5 is closed, the joint movement plate 29 is located upward through the lateral sliding plate 34, and a securing assisting plate pushing portion 68 formed at the joint movement plate 29 pushes up a securing pin 66*a* of the securing assisting plate 66. Then, according to rotation of the securing assisting plate 66, the cartridge securing lever 64 pivotally moves by operation of the pulling spring 67, and the bearing 62 of the image carrier 1 is secured by being pushed with a predetermined spring pressure against the cutout 63 of the apparatus body.

As shown in FIG. 5 and FIG. 11, in the state that the conveyance apparatus 5 is opened, the joint movement plate 29 moves downward through the lateral sliding plate 34, and the securing assisting plate pushing portion 68 formed at the joint movement plate 29 pushes down the securing pin 66*a* of the securing assisting plate 66. Then, the cartridge securing lever 64 rotates in the counterclockwise direction around the rotary shaft 65 as a center, and the bearing 62 of the image carrier 1 is disengaged as shown in FIG. 5 and FIG. 11, thereby entering into a state that the process cartridge 7 can be pulled out.

[Light Path Shielding Shutter Opening and Closing Mechanism]

Figure 12:
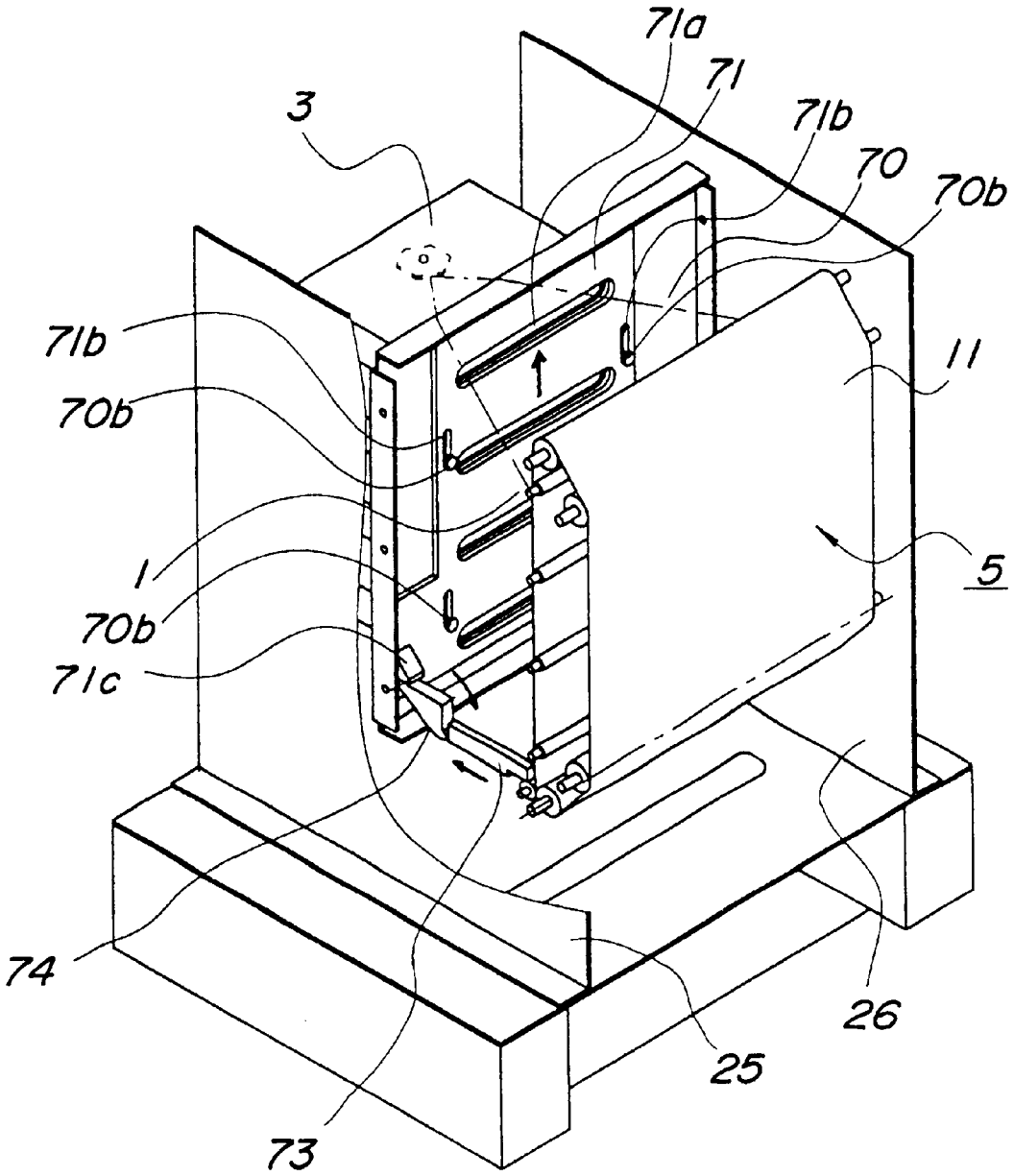
FIG. 12 is an illustration showing an optical path shielding shutter in a state that the transfer means is closed.

In this embodiment, a light path shielding shutter 71 is provided for shielding the light path from the scanner unit 3 as exposing means to the image carrier 1. The light path shielding shutter 71 is a plate material disposed along a vertical stay 70 of the apparatus body as shown in FIG. 12. The shutter is slidably structured in taking the shielding position and non-shielding position by passing a securing shaft 70*b* formed at the vertical stay 70 to a long hole 71*b* of the light path shielding shutter 71. In the vertical stay 70 and the light path shielding shutter 71, light path holes 70*a*, 71*a* are formed between the scanner units 3 and the image carriers 1.

A sliding plate 73 is formed below the conveyance apparatus 5, and a cam 74 changes the direction of force and is in contact with a projection 71*c* of the light path shielding shutter 71. Accordingly, as shown in FIG. 12, where the conveyance apparatus 5 is closed, the light path shielding shutter 71 is pushed up, and in this state, the light path holes 70*a*, 71*a* becomes coaxial to open the light path.

Figure 13:
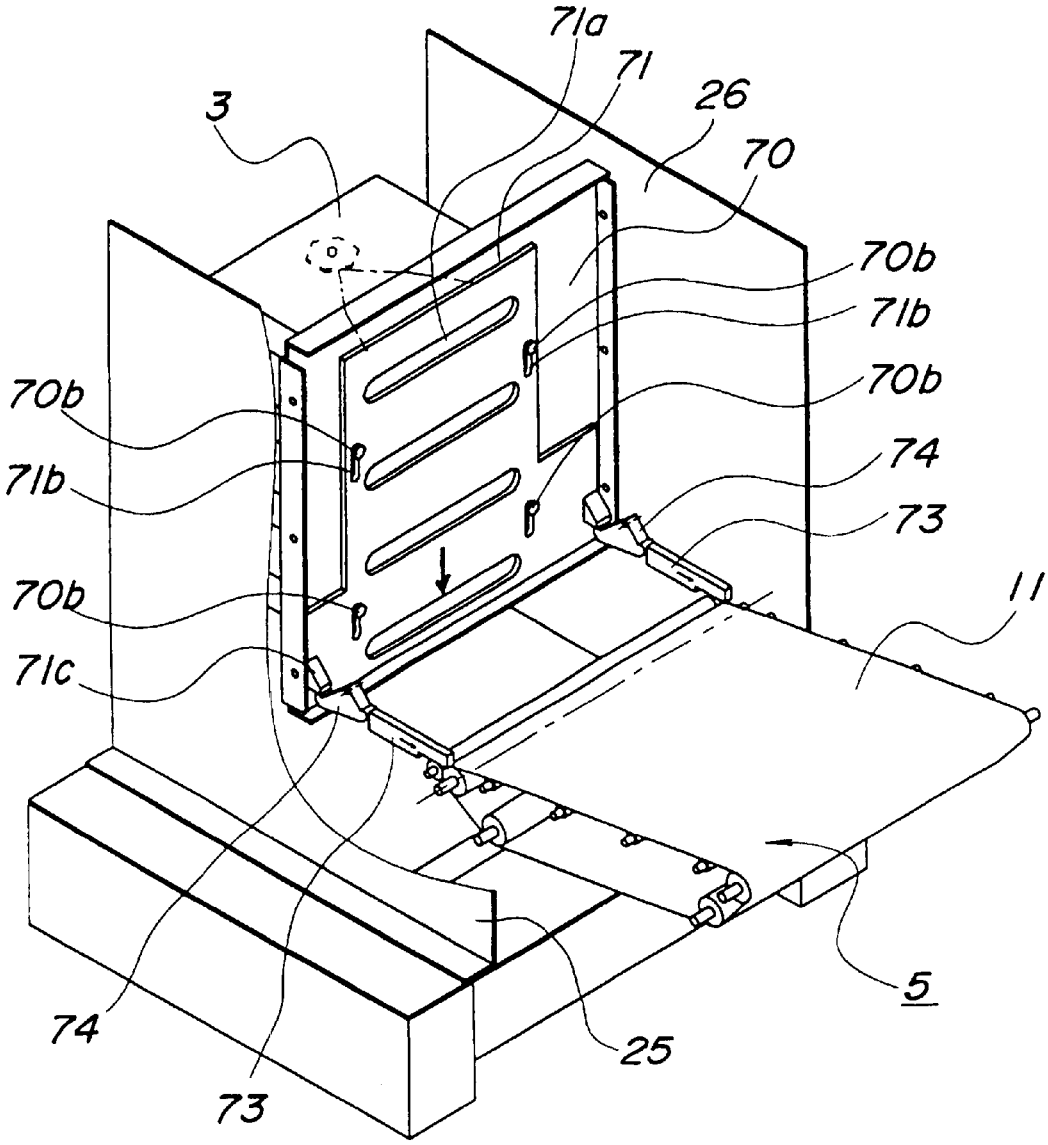
FIG. 13 is an illustration showing an optical path shielding shutter in a state that the transfer means is open.

As shown in FIG. 13, when the conveyance apparatus 5 is opened, the light path shielding shutter 71 moves down by self-weight or a link, thereby shielding the light path to the image carrier 1 from the scanner unit 3 by a shift between the light path hole 70*a* of the vertical stay 70 and the light path hole 71 a of the light path shielding shutter 71. With this structure, even where the conveyance apparatus 5 is opened and closed to attach or detach the process cartridge 7, the apparatus can prevent external light from reaching the scanner unit 3.

Second Embodiment

Figure 14:
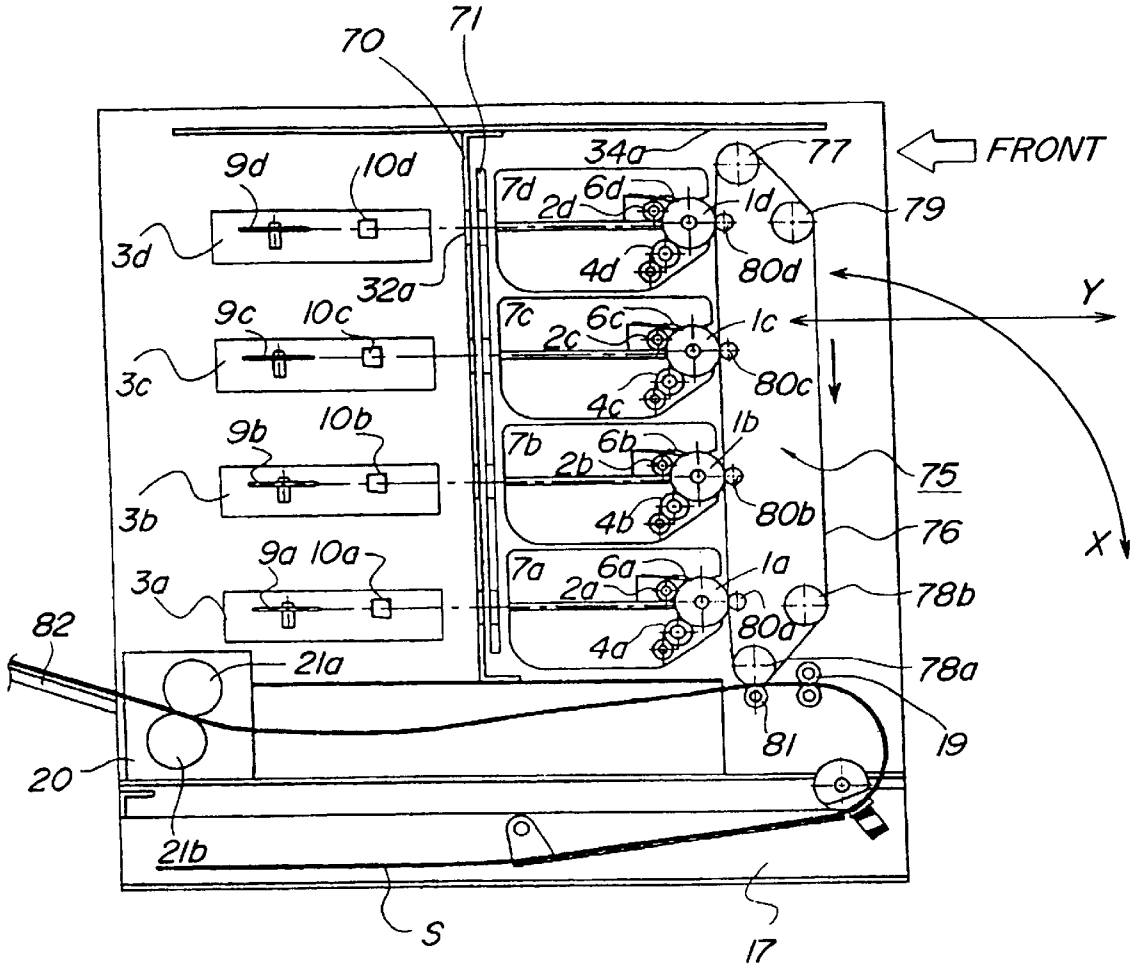
FIG. 14 is an illustration describing a structure of an image forming apparatus according to a second embodiment.

A second embodiment of the image forming apparatus according to the invention is described in reference to the drawings. FIG. 14 is an entire view of the image forming apparatus according to this embodiment, and in regard to portions corresponding to the portions in the first embodiment, a duplicated description is omitted in providing the same reference numbers.

In the above embodiment, in use of the conveyance apparatus 5, a toner image is directly transferred to a sheet conveyed from the image carrier 1, and the sheet S is delivered onto a top of the apparatus. However, in this embodiment, this apparatus includes an intermediate transfer unit 75 equipped with an intermediate transfer belt 76 as an intermediate transfer body, which is detachably attached to the apparatus body. With such an apparatus thus structured, the respective engagement disengagement means and the like can be moved jointly with swinging, opening, and closing of the intermediate transfer unit 75 in the same way as in the first embodiment.

The intermediate transfer unit 75 includes, as a united body, a drive roller 77, a driven roller 78*a*, 78*b*, and a tension roller 79 for tensioning the intermediate transfer belt 76. The intermediate transfer belt 76 is rotatively driven via a drive roller 77 from the drive source, not shown. The unit includes, as a united body, primary transfer rollers 80*a* to 80*d* formed on an inner peripheral side of the intermediate transfer belt 76, and the intermediate transfer belt 76 is pushed to the respective image carriers 1*a* to 1*d*, thereby transferring the toner images onto the intermediate transfer belt 76 in an overlapping manner.

A secondary transfer roller 81 (secondary transfer section) is arranged in opposing to the driven roller 78*a* located below the intermediate transfer unit 75 and secondarily transfers the toner images at a time on the intermediate transfer belt 76 to the sheet fed from the feeding section 16. Then, the sheet is conveyed to the fixing section 20 disposed on the rear side of the apparatus and delivered to and stacked at a delivery tray 82 after images are fixed in application of heats and pressure.

This invention is applicable, in substantially the same way as, to the image forming apparatus using such an intermediate transfer body. That is, after the intermediate transfer body unit is set in a state that the intermediate transfer body unit escapes (in X direction) from the respective image carriers as shifted from the state of the intermediate transfer body during the transfer process (the state that the intermediate transfer belt is in contact with the respective image carriers), the respective process cartridges can be detachably attached in Y direction utilizing a space formed in the apparatus body.

Where the intermediate transfer body unit is set in the escaping state, and even where a sheet may wrap over the intermediate transfer body unit at the secondary transfer section, such a wrapped sheet can be removed easily.

Third Embodiment

Figure 15:
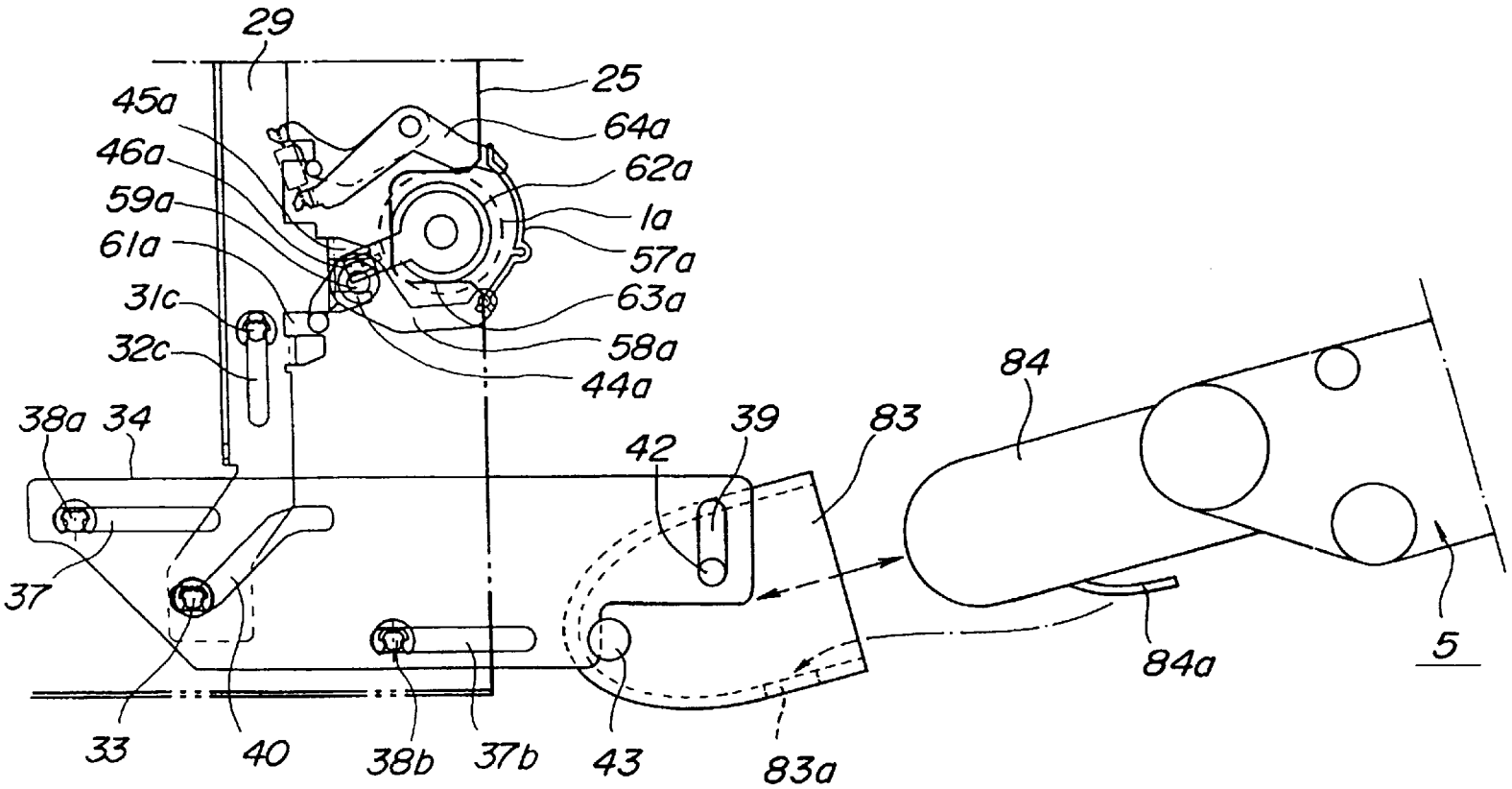
FIG. 15 is an illustration describing a structure of an image forming apparatus according to a third embodiment.
Figure 16:
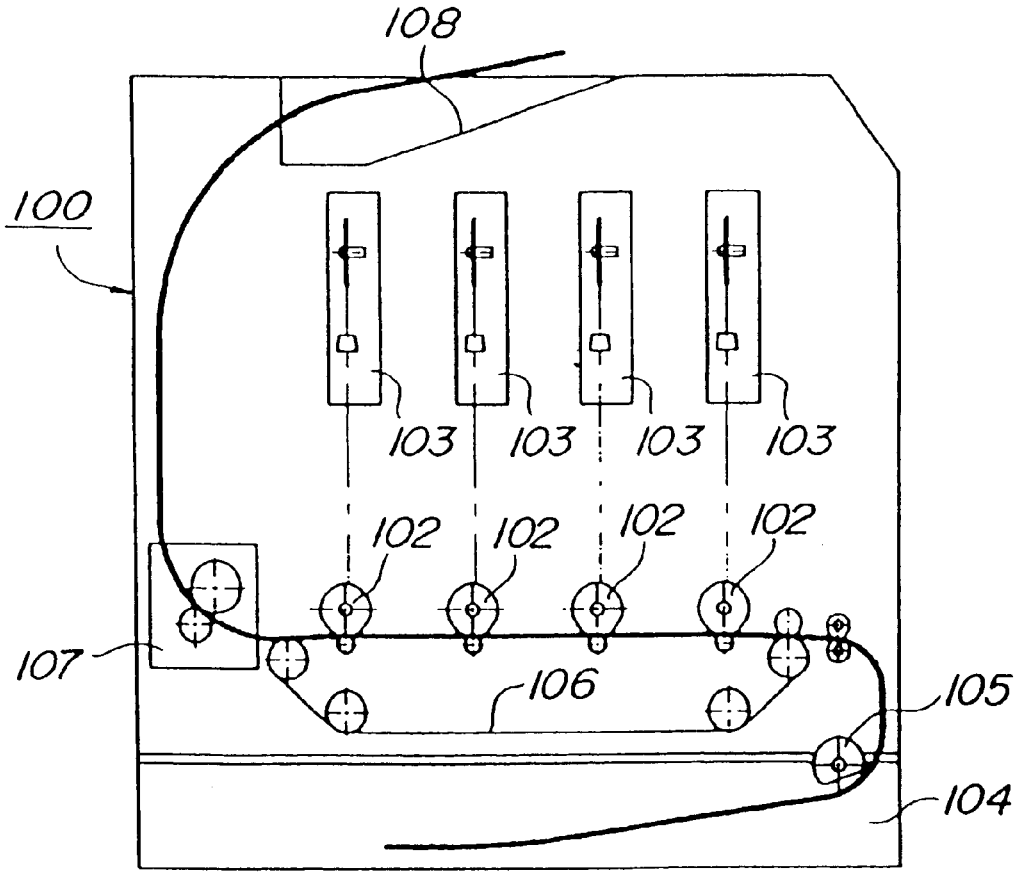
FIG. 16 (PRIOR ART)
FIG. 16 is an illustration describing a structure of a conventional image forming apparatus.
Figure 17:
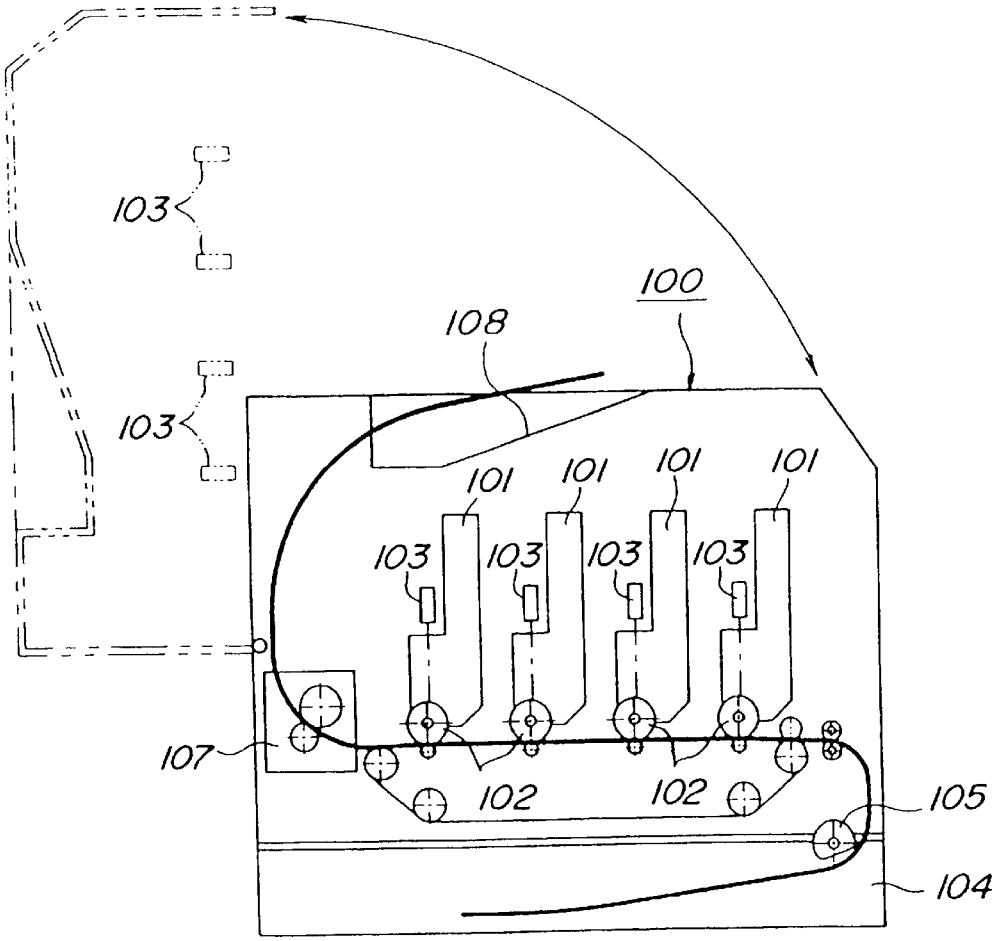
FIG.17 (PRIOR ART)
FIG. 17 is an illustration describing opening and closing operation of the apparatus in the conventional apparatus.

Referring to the drawings, a third embodiment of the image forming apparatus according to the invention is described. FIG. 15 is an entire view of the image forming apparatus according to the embodiment, and in regard with portions corresponding to the portions in the first embodiment, duplicated description is omitted in providing the same reference numbers.

In the above embodiment, the conveyance apparatus 5 is attached to a holder arranged at the apparatus body by connecting a connecting portion 84. The holder 83 is formed rotatably with a rotary shaft 43 with respect to the apparatus body. The holder 83 has a secured shaft 42 and is structured to jointly move the lateral sliding plate 34 and the joint movement plates 29, 30 in the same way as in the above embodiments.

The holder 83 has a hole 83*a*, and on the other hand, a snap fitter 84*a* is formed at the connecting portion 84 of the conveyance apparatus 5. The snap fitter 84*a* projects in the hole 83*a* from the elasticity of the fitter when the connecting portion 84 is inserted in the holder 83, thereby engaging the conveyance apparatus 5 so as not to detach therefrom easily. When the connecting portion 84 is detached from the holder 83, the snap fitter 84*a* is pushed through the hole 83*a* to remove the conveyance apparatus 5 upon releasing the engagement. The connecting portion 84 can be engaged to the holder 83 using nuts or other engaging means, not shown.

With the apparatus thus structured, the conveyance apparatus 5 can detachably attached very easily, and the conveyance belt 11 can be easily maintained and replaced.

Moreover, with respect to the intermediate transfer body unit as shown in the second embodiment, the detachably attaching mechanism of the conveyance apparatus 5 is applicable in substantially the same way as in the second embodiment.

Although in the above three embodiments the conveyance apparatus 5 or the intermediate transfer body unit 75 takes the state during the two states: the transfer process and the escaping state, this invention is not limited to this. For example, between jobs for image formation, the intermediate transfer body unit may be in a waiting mode as an intermediate state between the above two states (or a state having a shorter isolation distance than that of the escaping state).

As the above escaping state, for example, the respective process cartridge can be maintained, and replaced and the jammed paper can be removed in utilizing a space formed in the apparatus body created after the conveyance apparatus 5 or the intermediate transfer body unit 75 is pulled out of the apparatus body in a parallel direction toward the right side (see, FIG. 1, FIG. 14). That is, during maintenance and replacement work, the conveyance apparatus 5 or the intermediate transfer body unit 75 can be completely taken out of the apparatus body.

Although in the above embodiments the unit is to be swung after the door (a part of the external wall of the apparatus front side) on the front side of the apparatus body is opened, this invention is not limited to this. This invention is applicable where the door (external wall) is structured in a united body with the unit.

What is claimed is:

1. An image forming apparatus comprising:

an image carrier unit having an image carrier for carrying an image; and a transfer material carrier unit having a transfer material carrier for carrying a transfer material, the transfer material carrier unit taking a first state when the image on the image carrier is transferred onto the transfer material carried by the transfer material carrier and a second state in which the transfer material carrier unit is away from the image carrier unit more than in the first state, wherein the image carrier unit is detachably attached to an apparatus body through a space formed in the apparatus body after the transfer material carrier unit take the second state.

2. The image forming apparatus according to claim 1, wherein the image carrier unit is attached detachably to the apparatus body in substantially the same direction as the direction in which the transfer material carrier unit moves away from the image carrier unit to move from the first state to the second state.

3. The image forming apparatus according to claim 2, wherein the direction in which the transfer material carrier unit moves away from the image carrier unit to move from the first state to the second state is a direction substantially perpendicular to the conveyance direction the transfer material by the transfer material carrier.

4. The image forming apparatus according to claim 3, wherein the direction in which the transfer material carrier unit moves away from the image carrier unit to move from the first state to the second state is a direction substantially perpendicular to an extending direction of a rotary shaft of the transfer material carrier.

5. The image forming apparatus according to claim 2, wherein the image carrier unit and the transfer material carrier unit are attached detachably to a front side of the apparatus body.

6. The image forming apparatus according to claim 1, wherein the image carrier unit is attached detachably to the apparatus body in a direction substantially perpendicular to a rotational direction of the image carrier.

7. The image forming apparatus according to claim 6, wherein the image carrier unit is attached detachably to the apparatus body in a direction substantially perpendicular to a conveyance direction of a transfer material by the transfer material carrier.

8. The image forming apparatus according to claim 1, wherein the transfer material carrier unit swings between the first state and the second state around a swinging shaft, as a center.

9. The image forming apparatus according to claim 8, wherein the transfer material carrier unit is detachably attached to the apparatus body after the transfer material carrier unit takes the second state.

10. The image forming apparatus according to claim 1, wherein direction in which the transfer material carrier unit moves away from the image carrier unit to move from the first state to the second state is a direction substantially perpendicular to the conveyance direction of the transfer material by the transfer material carrier.

11. The image forming apparatus according to claim 10, wherein the direction in which the transfer material carrier unit moves away from the image carrier unit to move from the first state to the second state is a direction substantially perpendicular to an extending direction of a rotary shaft of the transfer material carrier.

12. The image forming apparatus according to claim 1, wherein the transfer material carrier unit is detachably attached to the apparatus body.

13. The image forming apparatus according to claim 1, wherein a conveyance direction of the transfer material conveyed by the transfer material carrier contains a vertical direction component.

14. The image forming apparatus according to claim 13, wherein the conveyance direction of the transfer material conveyed by the transfer material carrier is substantially vertical.

15. The image forming apparatus according to claim 14, wherein the conveyance direction of the transfer material conveyed by the transfer material carrier is substantially vertically upward.

16. The image forming apparatus according to claim 15, further comprising a plurality of image carrier units arranged along the conveyance direction of the transfer material conveyed by the transfer material carrier.

17. The image forming apparatus according to claim 16, wherein images on the respective image carriers are sequentially transferred onto the transfer material carried by the transfer material carrier.

18. The image forming apparatus according to claim 1, further comprising a plurality of image carrier units arranged along the conveyance direction of the transfer material conveyed by the transfer material carrier.

19. The image forming apparatus according to claim 18, wherein images on the respective image carriers are sequentially transferred onto the transfer material carried by the transfer material carrier.

20. The image forming apparatus according to claim 1, wherein the transfer material carrier has a belt shape.

21. The image forming apparatus according to claim 1, wherein the image carrier unit has a charging means for charging the surface of the image carrier.

22. The image forming apparatus according to claim 1, wherein the image carrier unit has a developing means for developing a latent image formed on the image carrier.

23. The image forming apparatus according to any of claim 1 to 22, further comprising drive means for driving the image carrier, wherein the image carrier is disengaged from the drive means in association with an operation in which the transfer material carrier unit moves away from the image carrier unit to move from the first state to the second state.

24. The image forming apparatus according to claim 23, wherein the drive means drives the image carrier by connecting to a rotary shaft of the image carrier, and wherein the rotary shaft of the image carrier is disengaged from the drive means in association with the operation in which the transfer material carrier unit moves away from the image carrier unit to move from the first state to the second state.

25. The image forming apparatus according to any of claim 1 to 22, further comprising securing means for securing the image carrier unit to the apparatus body after the image carrier unit is attached to the apparatus body, the securing means disengaging the image carrier unit from the apparatus body in association with an operation in which the transfer material carrier unit moves away from the image carrier unit to move from the first state to the second state.

26. The image forming apparatus according to any of claim 1 to claim 22, wherein the image carrier unit has a moving member movable to a protection position for protecting a surface of the image carrier and to an exposing position for exposing the surface of the image carrier, and wherein the moving member exists at the exposing position when the transfer material carrier unit is in the first state.

27. The image forming apparatus according to claim 26, wherein the moving member moves from the exposing position to the protection position in association with the operation in which the transfer material carrier unit moves away from the image carrier unit to move from the first state to the second state.

28. The image forming apparatus according to any of claim 1 to claim 22, further comprising exposing means for exposing a charged surface of the image carrier to light, and a moving member movable to a shielding position at which a light path from the exposing means to the image carrier is shielded and to a non-shielding position at which the light path is not shielded, wherein the moving member exists at the non-shielding position when the transfer material carrier unit is in the first state.

29. The image forming apparatus according to claim 28, wherein the moving member moves from the non-shielding position to the shielding position in association with the operation in which the transfer material carrier unit moves away from the image carrier unit to move from the first state to the second state.

30. An image forming apparatus comprising:

an image carrier unit having an image carrier carrying an image; and an intermediate transfer body unit having an intermediate transfer body, the intermediate transfer body unit taking a first state when the image on the image carrier is transferred onto the intermediate transfer body and a second state in which the intermediate transfer body unit is away from the image carrier unit more than when taking the first state, wherein the image on the intermediate transfer body is transferred to a transfer material, and wherein the image carrier unit is detachably attached to an apparatus body through a space formed in the apparatus body after the intermediate transfer body unit takes the second state.

31. The image forming apparatus according to claim 30, wherein the image carrier unit is attached detachably from the apparatus body in substantially the same direction as the direction in which the intermediate transfer body unit moves away from the image carrier unit to move from the first state to the second state.

32. The image forming apparatus according to claim 31, wherein the direction in which the intermediate transfer body unit moves away from the image carrier unit to move from the first state to the second state is a direction substantially perpendicular to a moving direction of the intermediate transfer body.

33. The image forming apparatus according to claim 32, wherein the direction in which the intermediate transfer body unit moves away from the image carrier unit to move from the first state to the second state is a direction substantially perpendicular to an extending direction of a rotary shaft of the intermediate transfer body.

34. The image forming apparatus according to claim 31, wherein the image carrier unit and the intermediate transfer body unit are attached detachably to a front side of the apparatus body.

35. The image forming apparatus according to claim 30, wherein the image carrier unit is attached detachably to the apparatus body in a direction substantially perpendicular to a rotational direction of the image carrier.

36. The image forming apparatus according to claim 35, wherein the image carrier unit is attached detachably to the apparatus body in a direction substantially perpendicular to the moving direction of the intermediate transfer body.

37. The image forming apparatus according to claim 30, wherein the intermediate transfer body unit swings between the first state and the second state around a swinging shaft as a center.

38. The image forming apparatus according to claim 37, wherein the intermediate transfer body unit is detachably attached to the apparatus body after the intermediate transfer body unit takes the second state.

39. The image forming apparatus according to claim 30, wherein the direction in which the intermediate transfer body unit moves away from the image carrier unit to move from the first state to the second state is a direction substantially perpendicular to the moving direction of the intermediate transfer body.

40. The image forming apparatus according to claim 39, wherein the direction in which the intermediate transfer body unit moves away from the image carrier unit to move from the first state to the second state is a direction substantially perpendicular to an extending direction of a rotary shaft of the intermediate transfer body.

41. The image forming apparatus according to claim 30, wherein the intermediate transfer body unit is detachably attached to the apparatus body.

42. The image forming apparatus according to claim 30, wherein a conveyance direction of the image conveyed by the intermediate transfer body contains a vertical direction component.

43. The image forming apparatus according to claim 42, wherein the conveyance direction of the image conveyed by the intermediate transfer body is substantially vertical.

44. The image forming apparatus according to claim 43, wherein the conveyance direction of the image conveyed by the intermediate transfer body is substantially vertically upward.

45. The image forming apparatus according to claim 44, further comprising a plurality of image carrier units arranged along the conveyance direction of the image conveyed by the intermediate transfer body.

46. The image forming apparatus according to claim 45, wherein images on the respective image carriers are sequentially transferred onto the intermediate transfer body, and wherein the images on the intermediate transfer body are transferred onto the transfer material.

47. The image forming apparatus according to claim 30, further comprising a plurality of image carrier units arranged along the conveyance direction of the image conveyed by the intermediate transfer body.

48. The image forming apparatus according to claim 47, wherein images on the respective image carriers are sequentially transferred onto the intermediate transfer body, and wherein the images on the intermediate transfer body are transferred onto the transfer material.

49. The image forming apparatus according to claim 30, wherein the intermediate transfer body has a belt shape.

50. The image forming apparatus according to claim 30, wherein the image carrier unit has a charging means for charging the surface of the image carrier.

51. The image forming apparatus according to claim 30, wherein the image carrier unit has a developing means for developing a latent image formed on the image carrier.

52. The image forming apparatus according to any of claim 30 to 51, further comprising drive means for driving the image carrier, wherein the image carrier is disengaged from the drive means in association with an operation in which the intermediate transfer body unit moves away from the image carrier unit to move from the first state to the second state.

53. The image forming apparatus according to claim 52, wherein the drive means drives the image carrier by connecting to a rotary shaft of the image carrier, and wherein the rotary shaft of the image carrier is disengaged from the drive means in association with the operation in which the intermediate transfer body unit moves away from the image carrier unit to move from the first state to the second state operation.

54. The image forming apparatus according to any of claim 30 to 51, further comprising securing means for securing the image carrier unit to the apparatus body after the image carrier unit is attached to the apparatus body, the securing means disengaging the image carrier unit from the apparatus body in association with the operation in which the intermediate transfer body unit moves away from the image carrier unit to move from the first state to the second state.

55. The image forming apparatus according to any of claim 30 to claim 51, wherein the image carrier unit has a moving member movable to a protection position for protecting a surface of the image carrier and to an exposing position for exposing the surface of the image carrier, and wherein the moving member exists at the exposing position when the intermediate transfer body unit is in the first state.

56. The image forming apparatus according to claim 55, wherein the moving member moves from the exposing position to the protection position in association with the operation in which the intermediate transfer body unit moves away from the image carrier unit to move from the first state to the second state.

57. The image forming apparatus according to any of claim 30 to claim 51, further comprising exposing means for exposing a charged surface of the image carrier to light, and a moving member movable to a shielding position at which a light path from the exposing means to the image carrier is shielded and to a non-shielding position at which the light path is not shielded, wherein the moving member exists at the non-shielding position when the intermediate transfer body unit is in the first state.

58. The image forming apparatus according to claim 57, wherein the moving member moves from the non-shielding position to the shielding position in association with the operation in which the intermediate transfer body unit moves away from the image carrier unit to move from the first state to the second state.

* * * * *

UNITED STATES PATENT AND TRADEMARK OFFICE

CERTIFICATE OF CORRECTION

PATENT NO. : 6,453,135 B1
DATED : September 17, 2002
INVENTOR(S) : Takao Sameshima et al.

It is certified that error appears in the above-identified patent and that said Letters Patent is hereby corrected as shown below:

Column 3,
Line 33, “eigen-resistance” should read -- resistance --.

Column 5,
Line 62, “describe.” should read -- described. --.

Column 6,
Line 13, “50a,50b” should read -- 50a, 50b --; and
Line 35, “engages” should read -- engage --.

Column 7,
Line 35, “dusts” should read -- dust --.

Column 10,
Line 2, “can” should read -- can be --; and
Line 60, “direction” should read -- direction of --.

Signed and Sealed this

First Day of July, 2003

JAMES E. ROGAN
*Director of the United States Patent and Trademark Office*